United States Patent [19]

Paulin

[11] 4,141,556

[45] Feb. 27, 1979

[54] GOLF PUTTER

[76] Inventor: Leo J. Paulin, 7315 Wisconsin Ave., Bethesda, Md. 20014

[21] Appl. No.: 769,114

[22] Filed: Feb. 16, 1977

[51] Int. Cl.[2] ..... A63B 53/04

[52] U.S. Cl. ..... 273/164; 273/167 A; 273/167 F; 273/167 G

[58] Field of Search ..... 273/77 R, 80 C, 80.2, 273/81 B, 81.2, 164, 167–175; D34/5 GC, 5 GH

[56] References Cited

U.S. PATENT DOCUMENTS

| | | | |
|---|---|---|---|
| D. 183,180 | 7/1958 | Phillips | D34/5 GH |
| D. 185,612 | 6/1959 | Phillips | D34/5 GH |
| D. 230,293 | 2/1974 | Gall | 273/164 X |
| 1,652,404 | 12/1927 | Graveure | 273/169 X |
| 1,690,388 | 11/1928 | Waldron | 273/167 G |
| 1,703,199 | 2/1929 | McClure | 273/80 C X |
| 2,445,718 | 7/1948 | Sternberg et al. | 273/164 X |
| 3,448,981 | 6/1969 | Anweiler | 273/80 C |
| 3,459,426 | 8/1969 | Sherwood | 273/164 X |
| 3,486,755 | 12/1969 | Hodge | 273/167 A X |
| 3,758,115 | 9/1973 | Hoglund | 273/164 |

*Primary Examiner*—Richard J. Apley

*Attorney, Agent, or Firm*—Scrivener, Parker, Scrivener & Clarke

[57] ABSTRACT

The invention provides a golf putter having a head of generally triangular shape in plan view with a substantially vertical striking surface and a bottom surface curved to prevent scraping of the ground surface on either putting or transverse movement. Marking means facilitating alignment of stroking movement with the ball are provided, together with means for positioning the shaft at an angular position with respect to the plane of the head.

1 Claim, 5 Drawing Figures

GOLF PUTTER

BACKGROUND OF THE INVENTION

1. Field of the Invention

The invention relates broadly to game apparatus useful in playing the game of golf and, more particularly, to a putter.

2. Description of the Prior Art

The voluminous prior art with respect to putters discloses, in general, putters having heads of generally triangular shape with substantially vertical, or slightly inclined, striking surface, and having means on the head for aligning the head and the putting stroke with the ball, such aligning means including a flange forming a right angle with the striking surface at the center thereof and extending rearwardly therefrom, and marking lines on the upper surface of the flange which provides the striking surface.

SUMMARY OF THE INVENTION

A golf putter having a head of novel construction and angular relation to the shaft is provided. The head comprises a substantially flat base of generally triangular shape having an upwardly extending flange extending along its one side and providing a striking surface, and a second flange forming a "T" with the first flange and extending from the mid point thereof to the opposite apex of the base. The bottom surface of the base is downwardly convex and shaped in a compound carvature both transversely and longitudinally of the direction of putting movement. A hostle extends upwardly from the base and the second flange and provides means for connecting the shaft to the head at an angle which insures parallel relation between the head and the ground surface.

DESCRIPTION OF THE PREFERRED EMBODIMENT

Figure 1:
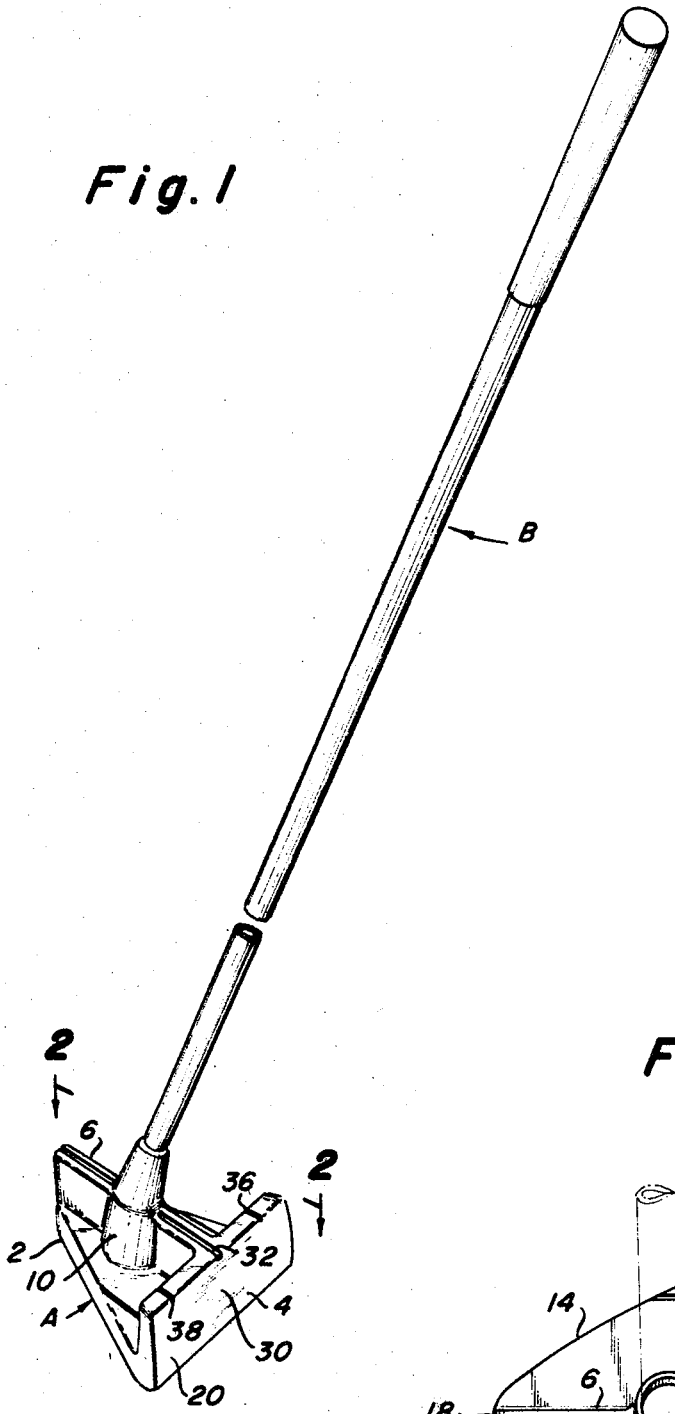
FIG. 1 is a perspective view of the golf putter provided by the invention.

A golf putter provided by the invention comprises generally the head A and shaft B. The head is a unitary, integral member which is preferably cast or otherwise formed of metal and comprises a generally flat base part 2 which is of generally triangular shape in horizontal plan, a flange 4 which extends substantially vertically upwardly from one side of the base, a second flange 6 which extends at right angles from the flange 4 at substantially the midpoint thereof across the upper surface of the base 2 to terminate at that apex 8 of the base which is opposite the flange 4, and a hostle 10 which extends upwardly from the base and the flange 6 to receive the shaft B and connect it to the head. These parts, and their functions and cooperation, will now be more fully described.

Figure 2:
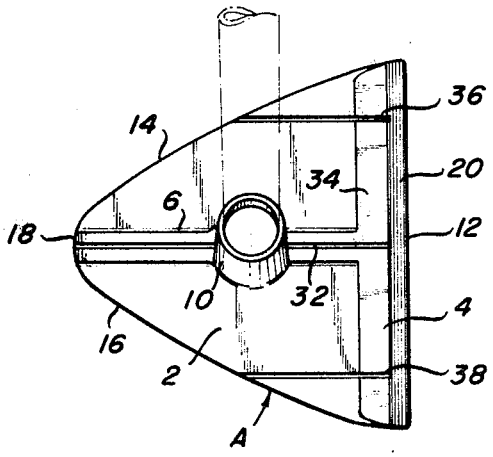
FIG. 2 is a sectional view through the head of the putter taken on line 2—2 of FIG. 1, and FIGS. 3, 4 and 5 are, respectively, side, front and rear elevational views of the head and part of the shaft of the putter.
Figure 4:
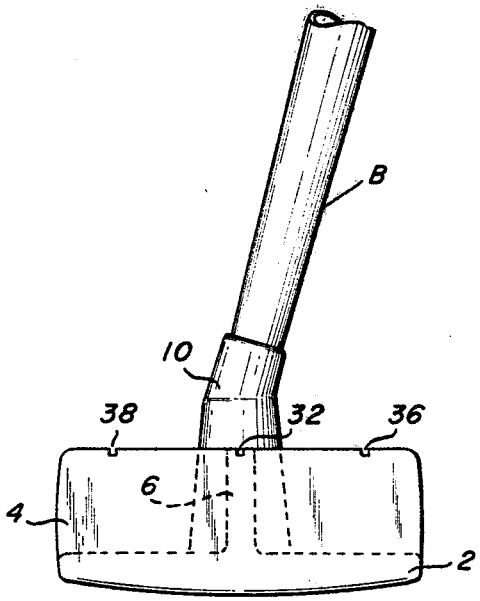
Figure 5:
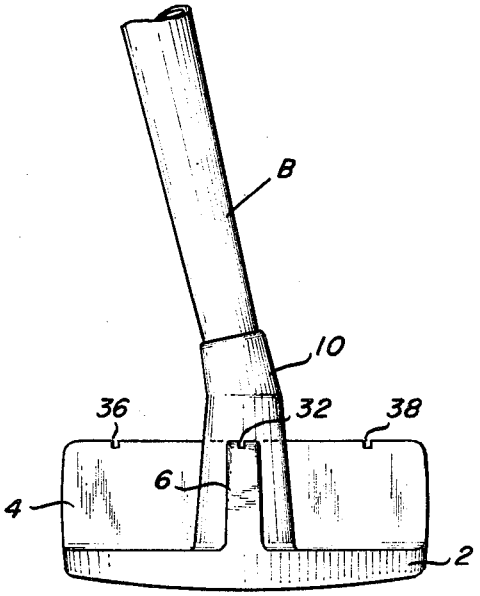

As most clearly shown in FIG. 2, the base 2 in general horizontal plan is shaped as an equilateral triangle having sides 12,14,16. The sides 14,16 extending from the ends of side 12 and converge to the apex 18, and are outwardly and equally curved, while side 12 is straight and without curvature. The bottom surface of the base, as clearly shown in FIGS. 3, 4 and 5 is downwardly and arcuately curved both longitudinally (which is in the direction of putting movement) and transversely, the curvature of the bottom surface in each of these directions preferably being that of a compound curve which is of less radius at and adjacent the sides 12, 14 and 16 of the base than at and adjacent the center area of the base although, if desired, the central area may be made substantially flat while the areas at and adjacent the sides of the base have substantially equal curvature of small radius.

Figure 3:
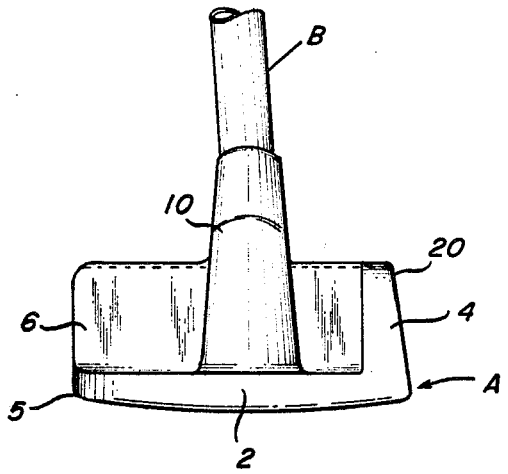

The flange 4 extends upwardly from the base 2 along and throughout the entire length of the side 12 of the base and its exterior major surface provides the striking face 20 of the putter which, in the preferred form of the invention, is slightly inclined to the vertical in the direction of the apex 18 of the base, as most clearly shown in FIG. 3 of the drawing, it being understood that the striking face 20 may be vertical instead of slightly inclined, and that the term "substantially vertical" as used herein includes the inclined surface flange 4. The surface 20, providing as it does the vertical striking face 20 of the putter, is only slightly greater in width than the diameter of a golf ball, and means are provided on the flange for aligning the flange with the ball during putting. Such means comprise, first, a visible marking 30 on the striking face 20 at the location of the "sweet spot" of the striking face, also a fore-and-aft extending groove or marking 32 on the upper edge surface 34 of the flange 4 at its transverse midpoint directly above the "sweet spot," and two fore-and-aft extending grooves or markings 36,38 on the upper edge surface 34 which are on opposite sides of the midpoint line 32 and are spaced apart a distance equal to the diameter of a golf ball. The entire length of the flange 4 is only slightly greater than the spacing of the markings 36,38 and in this specification and the appended claims the definition of the length of the flange 4 and its striking face as being "substantially equal to the diameter of a golf ball" will be understood to mean that it is of the order of that diameter instead of substantially greater.

The flange 6 surmounts the base 2 and extends from the rear of the flange 4 to the apex 18 of the base, intersecting flange 4 at right angles at the midpoint thereof, whereby the central marking line 32 lies midway between the side edges of flange 6. The upper surfaces of flanges 4 and 6 are preferably in substantially the same plane as particularly shown in FIG. 3 of the drawings.

The hostle 10 extends upwardly from the upper surface of the base 2 straddling the flange 6 and positioned substantially midway between the flange 4 and apex 18 of the base. When the head is viewed from its striking face or from the apex the upper part of the hostle is inclined to the vertical so that a straight shaft B received within it will extend at such an angle to the general plane of the base 6 that when the putter is held in normal putting position by a player for whom the shaft length is designed the base 2 of the putter will be substantially parallel to the ground surface beneath it. The direction of inclination of the hostle and shaft will obviously be reversed for right-handed and left-handed golfers.

I claim:

1. A golf club for use as a putter, comprising a head and a straight shaft, the head comprising a generally flat base which is shaped as an equilateral triangle with two outwardly curved side edges, a first flange connected to the base at the third edge thereof and extending upwardly therefrom and having a flat uninterrupted substantially vertical exterior surface forming a striking face the length of which is substantially equal to the diameter of a golf ball, a second flange extending upwardly from the base at substantially a right angle thereto and at its one end intersecting the midpoint of the first flange at a right angle and at its other end terminating at the apex of the base which is opposite the first flange, the base of the head having a lower surface which is downward convex both in the direction of striking movement of the club and transversely thereto and has a smaller radius at and adjacent each of the edges than at and adjacent its center, and three fore-and-aft extending lines on the upper surface of the first flange and extending in the direction of striking movement of the club, one line being at the transverse midpoint of the first flange and also extending along the length of the upper surface of the second flange, and the other two lines being on opposite sides of the one line and equi-distant therefrom and being spaced apart a distance substantially equal to the diameter of a golf ball, a two part hostle extending upwardly from the base, the hostle comprising a solid, vertical base portion integral with the second flange and extending equi-distant on either side of the flange and equi-distant from the first flange and the apex of the base and terminating at the upper edge of the second flange and a shaft receiving portion extending from the base portion and inclined to the base portion of the hostle to receive the shaft which is angularly disposed relative to the base of the head.

* * * * *